US011605874B1

(12) United States Patent
Tsai et al.

(10) Patent No.: US 11,605,874 B1
(45) Date of Patent: Mar. 14, 2023

(54) ANTENNA STRUCTURE AND ANTENNA-STRUCTURE COMBINATION METHOD

(71) Applicants: ONEWAVE TECHNOLOGY CO., LTD., Taipei (TW); Yun-Chan Tsai, Taipei (TW)

(72) Inventors: Yun-Chan Tsai, Taipei (TW); Po-Huai Huang, Taipei (TW); Shi-Hong Yang, Taipei (TW); Shi-Yu Chiu, Taipei (TW)

(73) Assignees: ONEWAVE TECHNOLOGY CO., LTD., Taipei (TW); Yun-Chan Tsai, Taipei (TW)

( * ) Notice: Subject to any disclaimer, the term of this patent is extended or adjusted under 35 U.S.C. 154(b) by 0 days.

(21) Appl. No.: 17/464,626

(22) Filed: Sep. 1, 2021

(51) Int. Cl.
*H01Q 1/22* (2006.01)
*H01Q 1/12* (2006.01)
*H01Q 23/00* (2006.01)

(52) U.S. Cl.
CPC ..... *H01Q 1/1207* (2013.01); *H01Q 1/2283* (2013.01); *H01Q 23/00* (2013.01)

(58) Field of Classification Search
CPC ..... H01Q 1/2283; H01Q 1/1207; H01Q 23/00
USPC ..... 343/700 R
See application file for complete search history.

(56) References Cited

U.S. PATENT DOCUMENTS

2007/0194996 A1* 8/2007 Hu ..... H01Q 1/125 343/702
2008/0079642 A1* 4/2008 Ishizuka ..... H01Q 9/42 343/702
2022/0232709 A1* 7/2022 Nagase ..... H05K 1/165

FOREIGN PATENT DOCUMENTS

| | | | |
|---|---|---|---|
| CN | 104934679 | A | 9/2015 |
| TW | I462390 | B | 11/2014 |
| TW | M589910 | U | 1/2020 |
| TW | M620249 | U | 11/2021 |

OTHER PUBLICATIONS

1st Office Action dated May 6, 2022 of the corresponding Taiwan patent application No. 110130816.
2nd Office Action dated Aug. 17, 2022 of the corresponding Taiwan patent application No. 110130816.

* cited by examiner

*Primary Examiner* — Peguy Jean Pierre
(74) *Attorney, Agent, or Firm* — Chun-Ming Shih; HDLS IPR SERVICES

(57) ABSTRACT

An antenna-structure combination method includes following steps. Provide a circuit board. At least one joint hole penetrating the circuit board is formed in the circuit board. At least one electrode layer and one feeding line are formed on a periphery of the joint hole. The feeding line is electrically connected to the electrode layer. Provide a chip antenna. The chip antenna includes a base. The base has a wiring section. A fixed connection section is arranged at one end of the wiring section. The fixed connection section is formed with a conductive layer. The fixed connection section of the chip antenna penetrates the joint hole of the circuit board, so that the conductive layer is electrically fixed to the electrode layer, so that the chip antenna is fixedly connected onto the circuit board in an upright manner.

24 Claims, 17 Drawing Sheets

ANTENNA STRUCTURE AND ANTENNA-STRUCTURE COMBINATION METHOD

BACKGROUND

Technical Field

The present disclosure relates to an antenna, and especially relates to an antenna structure that a chip antenna is through a circuit board and the chip antenna is electrically fixed onto the circuit board in an upright manner.

Description of Related Art

With the popularity of the Internet, people increasingly rely on the Internet, and more and more mobile-Internet apparatuses have been provided, such as desktop computers, notebook computers, tablet computers, e-readers, and smart phones. When the mobile-Internet apparatuses are popular in the market, it has also been reported that people are concerned about the need of the convenience for the Internet information acquisition and the Internet interpersonal interaction, which are followed by the stability of the reception and the transmission of the communication system.

The True Wireless Stereo (TWS) headsets are used on the market in the recent years. The principle of the TWS headset is that the mobile apparatus connects to the main (right) headset, and then the main (right) headset quickly connects to the secondary (left) headset wirelessly, to achieve the true wireless separation usage for the left channel and the right channel of the Bluetooth.

In the electronic products mentioned above, the wireless signals are necessary to be transmitted or received through an antenna structure, which includes a related art circuit board and a related art chip antenna. The related art electrode layer of the related art chip antenna and the related art conductive layer of the related art circuit board are welded together, so that the related art chip antenna is welded on the related art circuit board in an upright manner, and the related art metal layer on the related art chip antenna is electrically connected to the related art feeding line on the related art circuit board. Therefore, the signals between the related art electronic products can be transmitted or connected to the Internet for use.

Because the related art electrode layer of the related art chip antenna mentioned above is soldered to the related art conductive layer of the related art circuit board through the solder, after soldering, the length of the related art chip antenna itself plus the thickness of the solder increase the height of the related art chip antenna standing upright on the related art circuit board. The limited space and the limited location for arranging the related art antenna structure of the related art electronic product will cause the related art antenna structure to be difficult to arrange. Moreover, when soldering the related art electronic circuits, if the solder is not completely melted, removing the heat source will cause poor circuit connection, which is called the cold solder joint. Therefore, during the arrangement process of the related art antenna structure, when the related art chip antenna is accidentally affected by the external forces, the related art chip antenna and the related art circuit board are easy to be separated or fall off, causing the damage to the related art antenna structure.

SUMMARY

Therefore, the main object of the present disclosure is to solve the problems mentioned above. The antenna structure of the present disclosure is redesigned to allow the chip antenna to pass through the circuit board vertically and then to be electrically connected to the circuit board, which not only makes the chip antenna be firmly and electrically fixed on the circuit board, but also the height of the chip antenna standing upright on the circuit board can be reduced at the same time, so that the antenna structure is easily arranged and used in the electronic products.

In order to achieve the object mentioned above, the present disclosure provides an antenna-structure combination method including following steps. Provide a circuit board. At least one joint hole which is defined by the circuit board and through the circuit board is formed in the circuit board. At least one electrode layer of the circuit board and one feeding line of the circuit board are formed on a periphery of the joint hole. The feeding line is electrically connected to the electrode layer. Provide a chip antenna. The chip antenna includes a base. The base has a wiring section. A fixed connection section of the wiring section is arranged at one end of the wiring section. The fixed connection section is formed with a conductive layer. The fixed connection section of the chip antenna penetrates the joint hole of the circuit board, so that the conductive layer is electrically fixed to the electrode layer, so that the chip antenna is fixedly connected onto the circuit board in an upright manner.

In an embodiment of the present disclosure, the chip antenna is fixedly connected onto the circuit board in a vertical upright manner.

In an embodiment of the present disclosure, the chip antenna is fixedly connected onto the circuit board in a horizontal upright manner.

In an embodiment of the present disclosure, a grounding layer of the circuit board is formed on:

a front side of the circuit board or a back side of the circuit board; or both the front side and the back side (in an embodiment, one grounding layer is formed on the front side while another grounding layer is formed on the back side).

Moreover, a clearance area of the circuit board is formed on the back side of the circuit board, and the clearance area is corresponding to the electrode layer on the front side of the circuit board.

In an embodiment of the present disclosure, the joint hole is formed (defined) inside a body of the circuit board, or at a side of the body of the circuit board to be formed (defined) as a U-shaped side hole.

In an embodiment of the present disclosure, the joint hole is single-hole, two-hole or three-hole.

In an embodiment of the present disclosure, the chip antenna is made of a ceramic material or a glass fiber material.

In an embodiment of the present disclosure, the wiring section is formed with a metal layer.

In an embodiment of the present disclosure, the metal layer includes a plurality of straight lines arranged on a surface of the base and a plurality of conductive pillars penetrating the base. The conductive pillars are through the base and are electrically connected to the straight lines arranged on the surface of the base, so that the straight lines and the conductive pillars are spirally wound on the base.

In an embodiment of the present disclosure, the fixed connection section is a column shape, a plurality of pins, a plurality of terminals, a recessed part or a U-shaped notch.

In an embodiment of the present disclosure, the joint hole is located (defined) on the side of the circuit board and has a specific distance from the side. The electrode layer is arranged on the periphery of the joint hole and the specific distance, and the electrode layer is electrically connected to the feeding line.

In an embodiment of the present disclosure, a lower part of the U-shaped notch of the chip antenna is through the circuit board to be fixedly connected to the joint hole, and the U-shaped notch is connected across on the specific distance of the circuit board, so that the conductive layer is electrically connected to the electrode layer.

In order to achieve the object mentioned above, the present disclosure further provides an antenna structure including a circuit board and a chip antenna. At least one joint hole which is defined by the circuit board and through the circuit board is formed in the circuit board. At least one electrode layer of the circuit board and one feeding line of the circuit board are formed on a periphery of the joint hole. The feeding line is electrically connected to the electrode layer. The chip antenna includes a base. The base has a wiring section. A fixed connection section of the wiring section is arranged at one end of the wiring section. The fixed connection section is formed with a conductive layer. Moreover, the fixed connection section of the chip antenna is through the joint hole of the circuit board, so that the conductive layer is electrically fixed to the electrode layer, so that the chip antenna is fixedly connected onto the circuit board in an upright manner.

In an embodiment of the present disclosure, the chip antenna is fixedly connected onto the circuit board in a vertical upright manner.

In an embodiment of the present disclosure, the chip antenna is fixedly connected onto the circuit board in a horizontal upright manner.

In an embodiment of the present disclosure, a grounding layer of the circuit board is formed on:

a front side of the circuit board or a back side of the circuit board; or both the front side and the back side (in an embodiment, one grounding layer is formed on the front side while another grounding layer is formed on the back side).

Moreover, a clearance area of the circuit board is formed on the back side of the circuit board, and the clearance area is corresponding to the electrode layer on the front side of the circuit board.

In an embodiment of the present disclosure, the joint hole is formed (defined) inside a body of the circuit board, or at a side of the body of the circuit board to be formed (defined) as a U-shaped side hole.

In an embodiment of the present disclosure, the joint hole is single-hole, two-hole or three-hole.

In an embodiment of the present disclosure, the chip antenna is made of a ceramic material or a glass fiber material.

In an embodiment of the present disclosure, the wiring section is formed with a metal layer.

In an embodiment of the present disclosure, the metal layer includes a plurality of straight lines arranged on a surface of the base and a plurality of conductive pillars through the base. The conductive pillars are through the base and are electrically connected to the straight lines arranged on the surface of the base, so that the straight lines and the conductive pillars are spirally wound on the base.

In an embodiment of the present disclosure, the fixed connection section is a column shape, a plurality of pins, a plurality of terminals, a recessed part or a U-shaped notch.

In an embodiment of the present disclosure, the joint hole is located (defined) on the side of the circuit board and has a specific distance from the side. The electrode layer is arranged on the periphery of the joint hole and the specific distance, and the electrode layer is electrically connected to the feeding line.

In an embodiment of the present disclosure, a lower part of the U-shaped notch of the chip antenna is through the circuit board to be fixedly connected to the joint hole, and the U-shaped notch is connected across on the specific distance of the circuit board, so that the conductive layer is electrically connected to the electrode layer.

DETAILED DESCRIPTION

Figure 1:
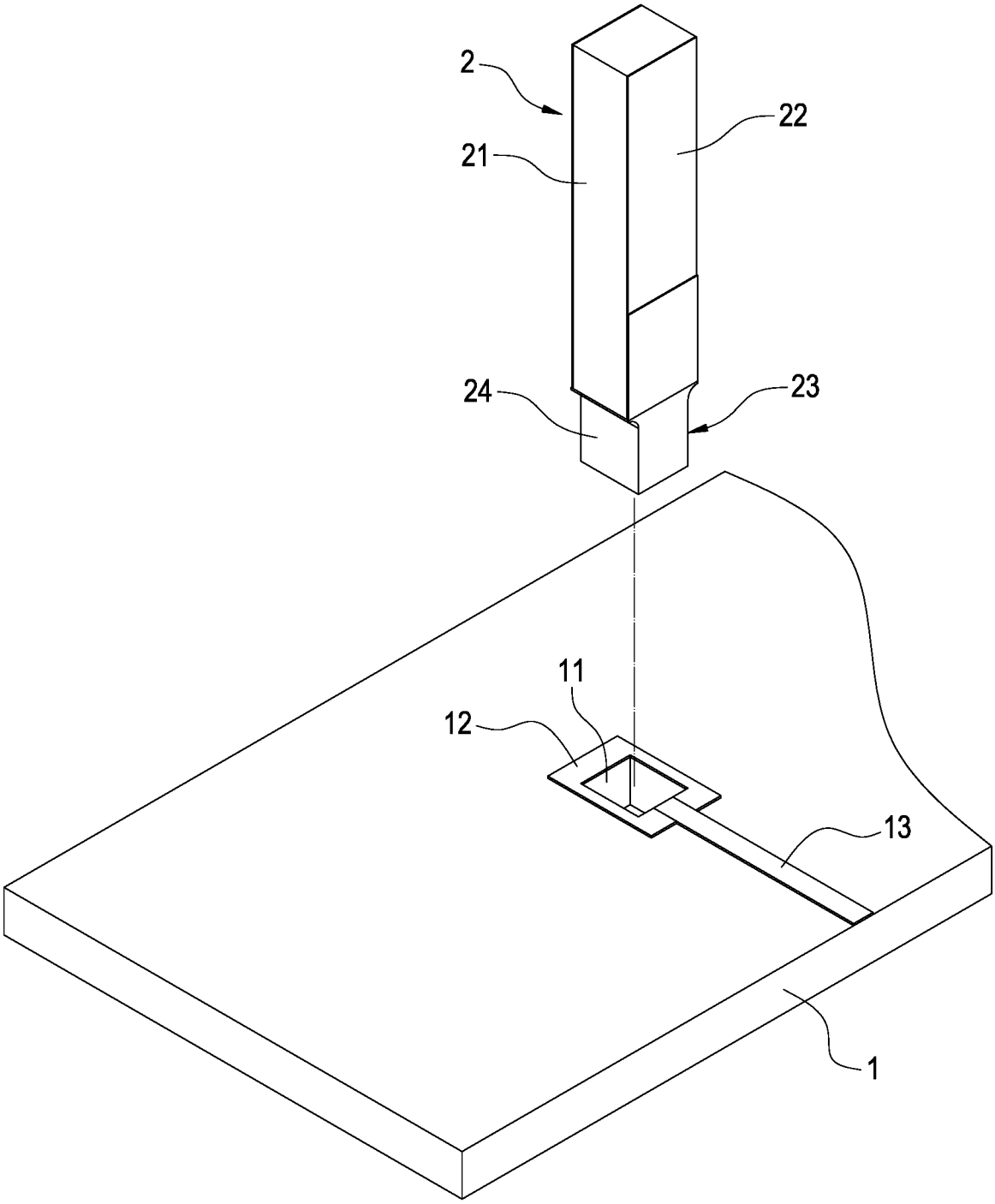
FIG. 1 shows an exploded view of the first embodiment of the antenna structure of the present disclosure.
Figure 2:
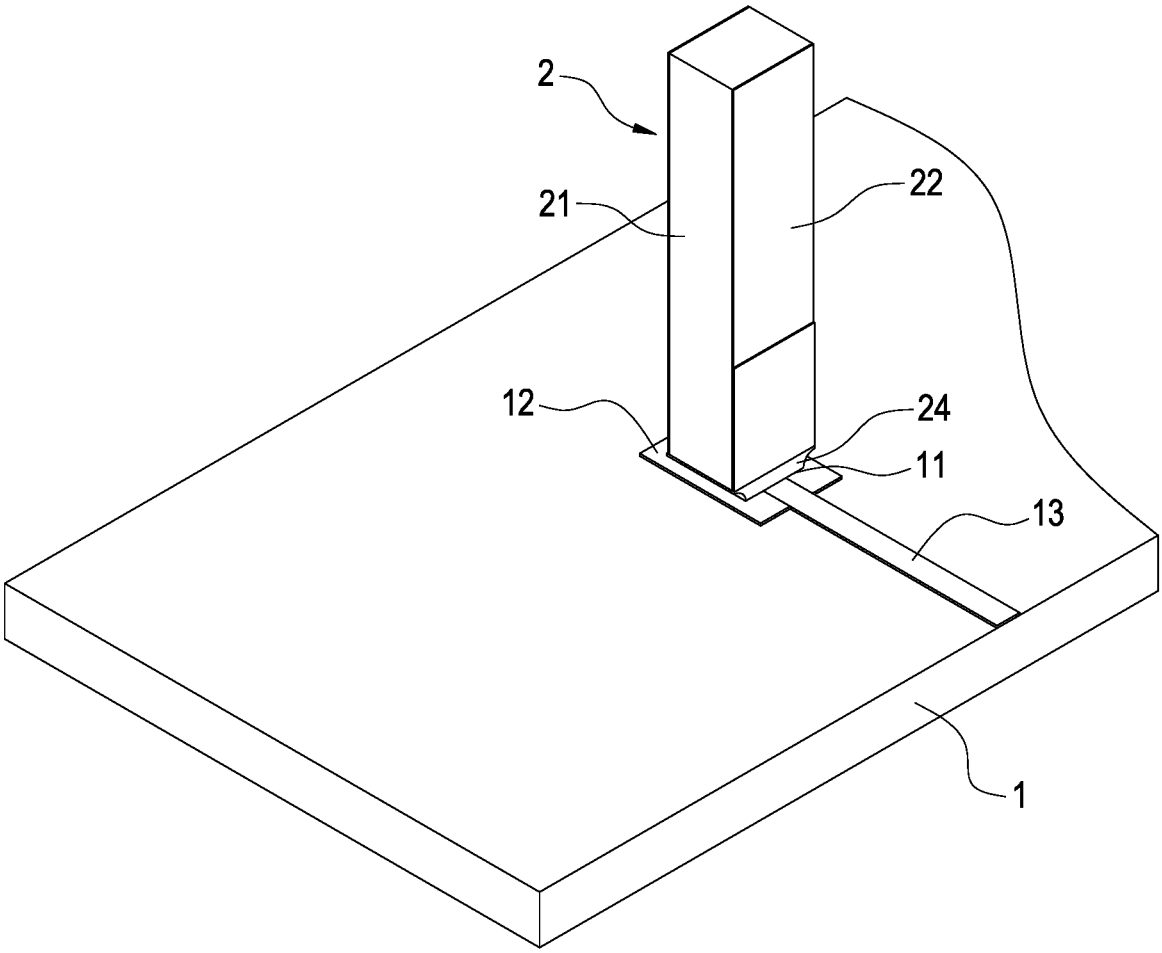
FIG. 2 shows a three-dimensional combination drawing of FIG. 1.
Figure 3:
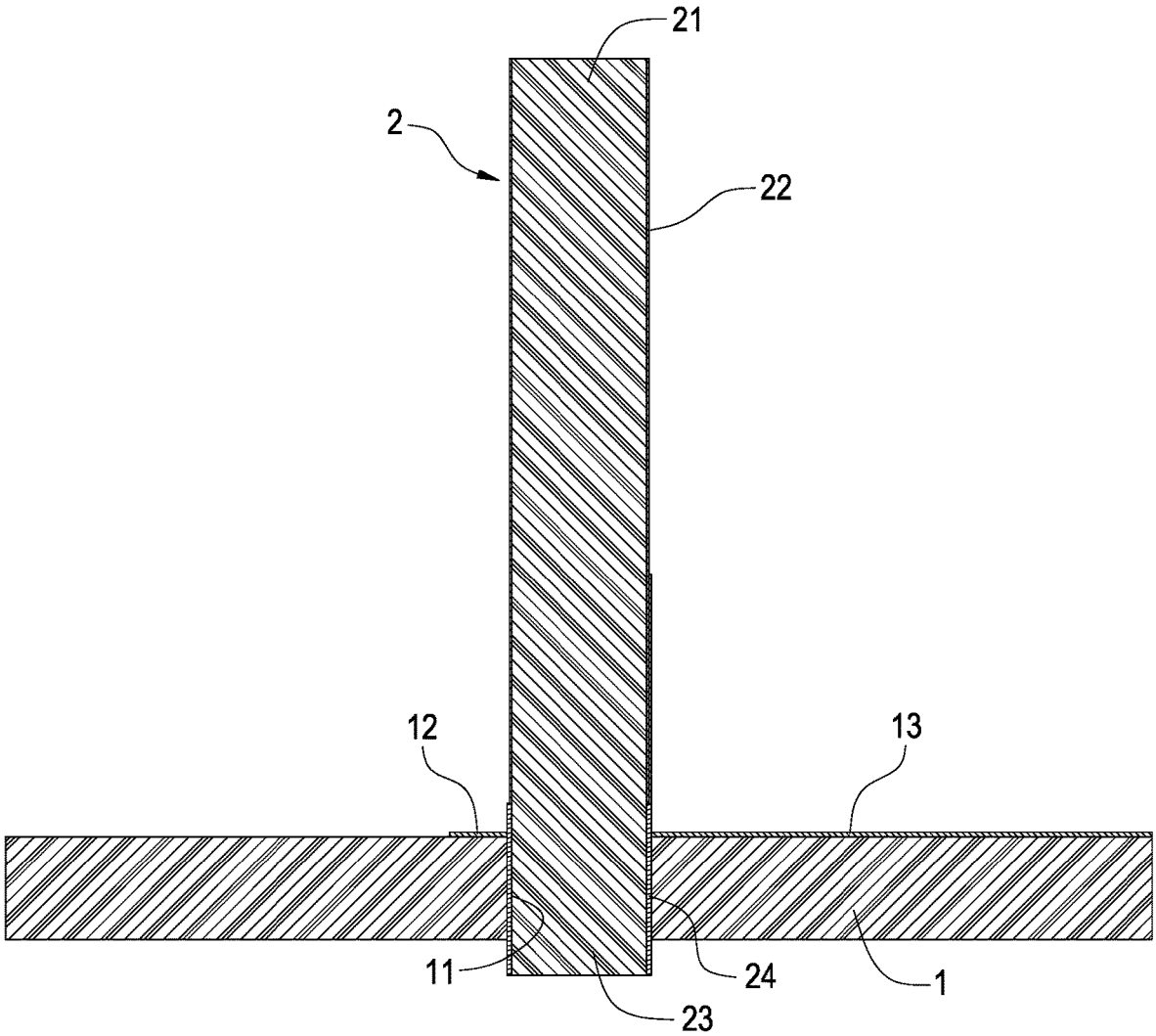
FIG. 3 shows a side sectional view of FIG. 2.

With regard to the technical contents and detailed descriptions of the present disclosure, now it is explained as follows in conjunction with the drawings:

FIG. 1 shows an exploded view of the first embodiment of the antenna structure of the present disclosure. FIG. 2 shows a three-dimensional combination drawing of FIG. 1. FIG. 3 shows a side sectional view of FIG. 2. As shown in FIG. 1, FIG. 2 and FIG. 3, an antenna-structure combination method of the present disclosure includes following steps. Firstly, provide a circuit board 1. At least one joint hole 11 which is defined by the circuit board 1 and through the circuit board 1 is formed in the circuit board 1. At least one electrode layer 12 of the circuit board 1 is formed on a periphery of the joint hole 11. Moreover, one feeding line 13 of the circuit board 1 is formed on the circuit board 1. The feeding line 13 is electrically connected to the electrode layer 12. Moreover, a grounding layer (not shown in FIG. 1, FIG. 2 and FIG. 3) of the circuit board 1 is formed on: a front side of the circuit board 1 or a back side of the circuit board 1; or both the front side and the back side (in an embodiment, one grounding layer is formed on the front side while another grounding layer is formed on the back side). The grounding layer is provided for the use of the antenna grounding. Moreover, a clearance area (not shown in FIG. 1, FIG. 2 and FIG. 3) of the circuit board 1 is formed on the back side of the circuit board 1. The clearance area is corresponding to the electrode layer 12 on the front side of the circuit board 1. The main function of the clearance area is to keep the metal away from the antenna body (metal shield), and the resonance frequency can also be changed by changing the size of the clearance area. Moreover, the clearance area changes the division of the near field and the far field of the antenna to a certain extent. In FIG. 1, FIG. 2 and FIG. 3, the joint hole 11 is formed (defined) inside a body of the circuit board 1 (as shown in FIGS. 1~8, 16 and 17), or at a side of the body of the circuit board 1 to be formed (defined) as a side hole (as shown in FIGS. 9~15).

Moreover, provide a chip antenna 2. The chip antenna 2 is made of a ceramic material or a glass fiber material. The chip antenna 2 includes a base 21. The base 21 has a wiring section 22. A fixed connection section 23 of the wiring section 22 is arranged at one end of the wiring section 22. The wiring section 22 is formed with a metal layer (not shown in FIG. 1, FIG. 2 and FIG. 3) by the printing technology or the etching technology. The metal layer, for example but not limited to, includes a plurality of straight lines arranged on a surface of the base 21 and a plurality of conductive pillars penetrating the base 21. The conductive pillars are through the base 21 and are electrically connected to the straight lines arranged on the surface of the base 21, so that the straight lines and the conductive pillars are spirally wound on the base 21, to form the metal layer. Moreover, the fixed connection section 23 is formed with a conductive layer 24 electrically connected to the metal layer. In FIG. 1, FIG. 2 and FIG. 3, the fixed connection section 23 is a column shape, a plurality of pins, a plurality of terminals, a recessed part or a U-shaped notch.

When the circuit board 1 and the chip antenna 2 are electrically combined, the fixed connection section 23 of the chip antenna 2 penetrates the joint hole 11 of the circuit board 1, so that the conductive layer 24 is electrically connected to the electrode layer 12. After the circuit board 1 and the chip antenna 2 are fixedly connected, the chip antenna 2 is fixedly connected onto the circuit board 1 in a vertical upright manner or a horizontal upright manner to reduce the height. The chip antenna 2 is firmly and electrically fixed to the circuit board 1 at the same time. In the case of limited space for the arrangement of the antenna structure inside the electronic product, this antenna structure design can easily adjust the height of the chip antenna 2 standing on the surface of the circuit board 1, which can greatly reduce the problem of arranging the antenna structure of the electronic product.

FIG. 1 shows an exploded view of the first embodiment of the antenna structure of the present disclosure. FIG. 2 shows a three-dimensional combination drawing of FIG. 1. FIG. 3 shows a side sectional view of FIG. 2. As shown in FIG. 1, FIG. 2 and FIG. 3, an antenna structure of the present disclosure includes a circuit board 1 and a chip antenna 2. Moreover, the chip antenna 2 is through the circuit board 1 and is electrically fixed onto the circuit board 1 in an upright manner.

At least one joint hole 11 which is defined by the circuit board 1 and through the circuit board 1 is formed in the circuit board 1. At least one electrode layer 12 of the circuit board 1 is formed on a periphery of the joint hole 11. Moreover, one feeding line 13 of the circuit board 1 is formed on the circuit board 1. The feeding line 13 is electrically connected to the electrode layer 12. Moreover, a grounding layer (not shown in FIG. 1, FIG. 2 and FIG. 3) of the circuit board 1 is formed on: a front side of the circuit board 1 or a back side of the circuit board 1; or both the front side and the back side (in an embodiment, one grounding layer is formed on the front side while another grounding layer is formed on the back side). The grounding layer is provided for the use of the antenna grounding. Moreover, a clearance area (not shown in FIG. 1, FIG. 2 and FIG. 3) of the circuit board 1 is formed on the back side of the circuit board 1. The clearance area is corresponding to the electrode layer 12 on the front side of the circuit board 1. The main function of the clearance area is to keep the metal away from the antenna body (metal shield), and the resonance frequency can also be changed by changing the size of the clearance area. Moreover, the clearance area changes the division of the near field and the far field of the antenna to a certain extent. In FIG. 1, FIG. 2 and FIG. 3, the joint hole 11 is formed (defined) inside a body of the circuit board 1, or at a side of the body of the circuit board 1 to be formed (defined) as a side hole.

The chip antenna 2 is made of a ceramic material or a glass fiber material. The chip antenna 2 includes a base 21. The base 21 has a wiring section 22. A fixed connection section 23 of the wiring section 22 is arranged at one end of the wiring section 22. The wiring section 22 is formed with a metal layer (not shown in FIG. 1, FIG. 2 and FIG. 3) by the printing technology or the etching technology. The metal layer, for example but not limited to, includes a plurality of straight lines arranged on a surface of the base 21 and a plurality of conductive pillars is through the base 21. The conductive pillars are through the base 21 and are electrically connected to the straight lines arranged on the surface of the base 21, so that the straight lines and the conductive pillars are spirally wound on the metal layer on the base 21. Moreover, the fixed connection section 23 is formed with a conductive layer 24 electrically connected to the metal layer. In FIG. 1, FIG. 2 and FIG. 3, the fixed connection section 23 is a column shape, a plurality of pins, a plurality of terminals or a U-shaped notch.

When the circuit board 1 and the chip antenna 2 are electrically combined, the fixed connection section 23 of the chip antenna 2 is through the joint hole 11 of the circuit board 1, so that the conductive layer 24 is electrically connected to the electrode layer 12. After the circuit board 1 and the chip antenna 2 are fixedly connected, the chip antenna 2 is fixedly connected onto the circuit board 1 in a vertical upright manner or a horizontal upright manner to reduce the height. The chip antenna 2 is firmly and electrically fixed to the circuit board 1 at the same time. In the case of limited space for the arrangement of the antenna structure inside the electronic product, this antenna structure design can easily adjust the height of the chip antenna 2 standing on the surface of the circuit board 1, which can greatly reduce the problem of arranging the antenna structure of the electronic product.

Figure 4:
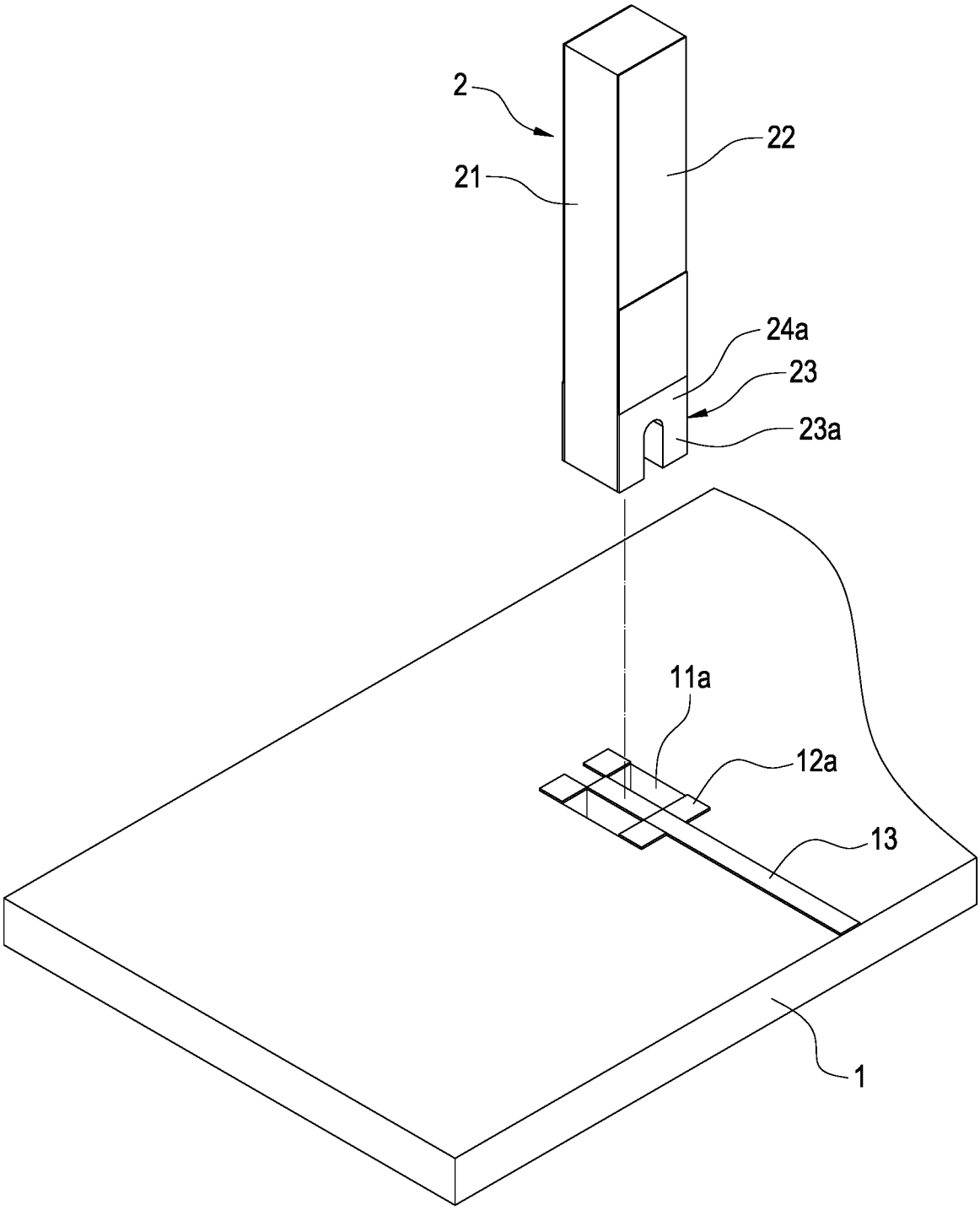
FIG. 4 shows an exploded view of the second embodiment of the antenna structure of the present disclosure.
Figure 5:
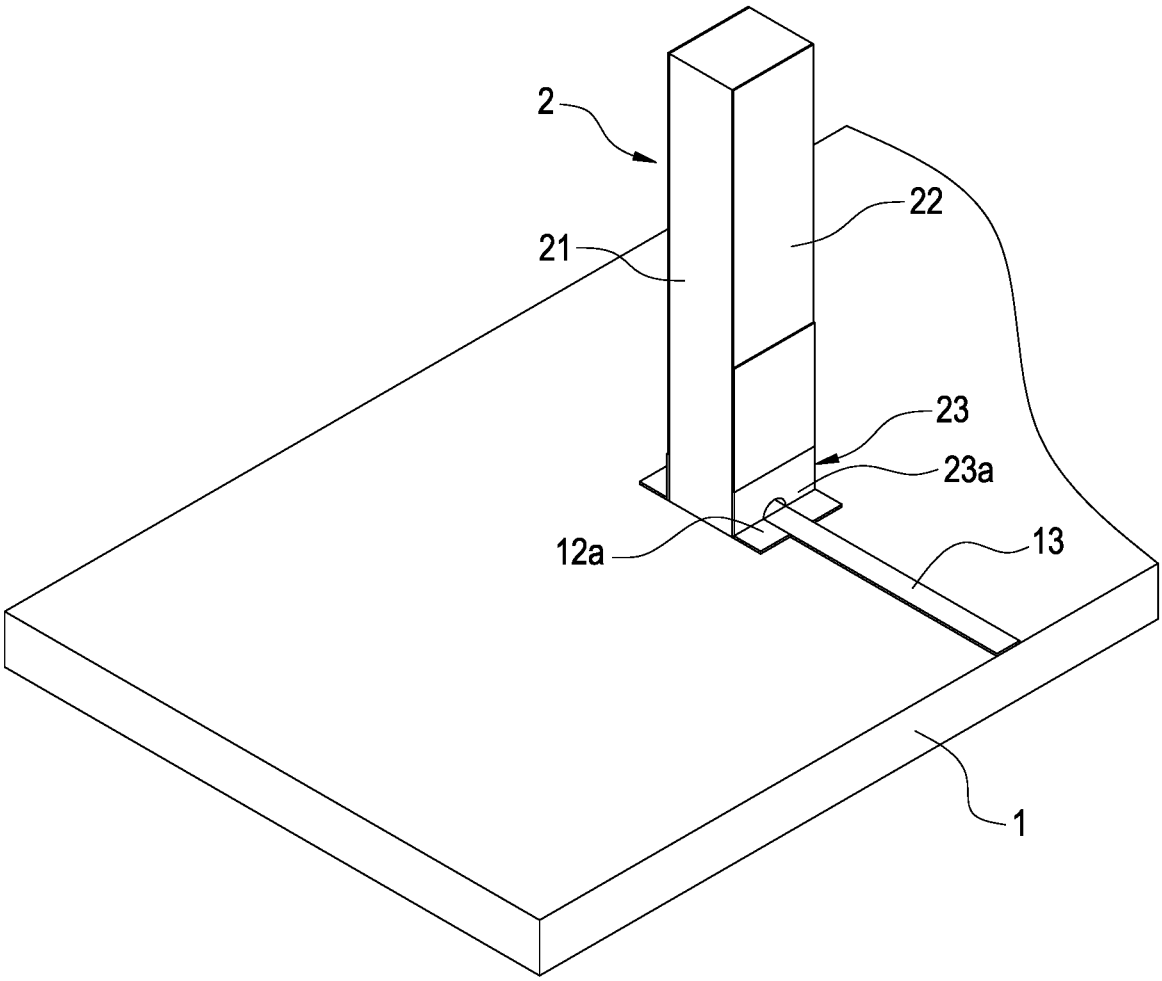
FIG. 5 shows a three-dimensional combination drawing of FIG. 4.
Figure 6:
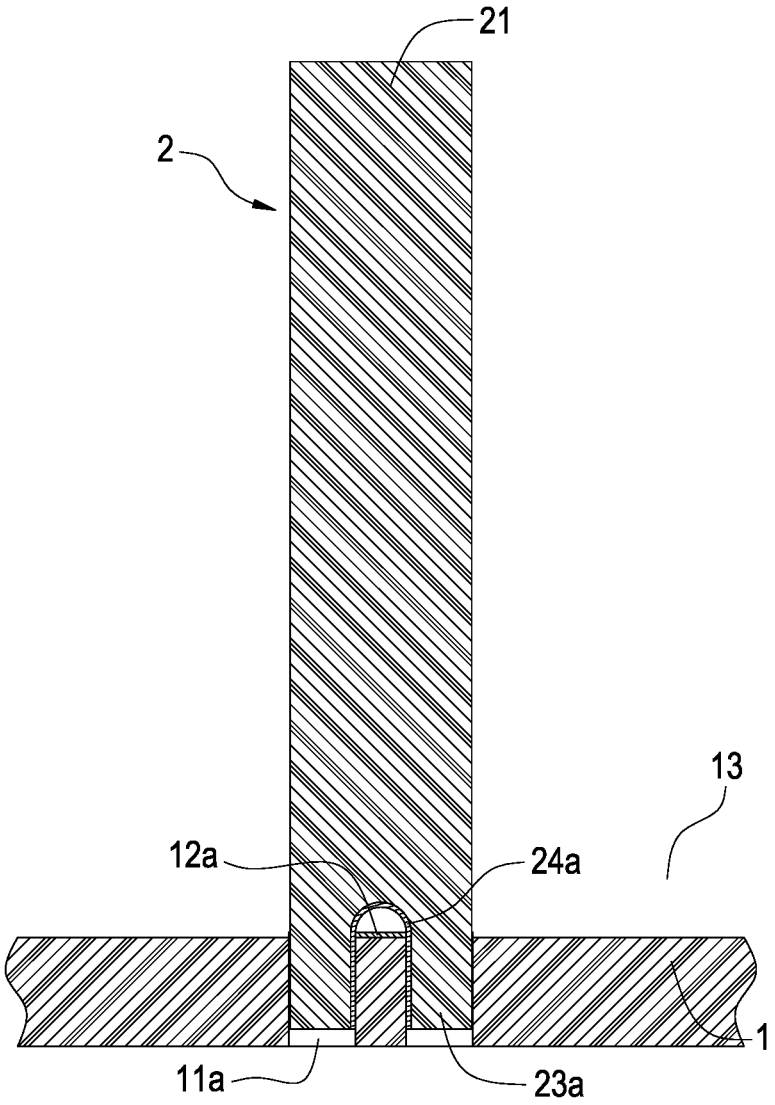
FIG. 6 shows a side sectional view of FIG. 5.

FIG. 4 shows an exploded view of the second embodiment of the antenna structure of the present disclosure. FIG. 5 shows a three-dimensional combination drawing of FIG. 4. FIG. 6 shows a side sectional view of FIG. 5. As shown in FIG. 4, FIG. 5 and FIG. 6, this embodiment is roughly the same as the first embodiment, except that the joint holes 11*a* of the circuit board 1 are a plurality of holes. In this embodiment, the joint holes 11*a* are two holes. At least one electrode layer 12*a* of the circuit board 1 is formed on a periphery of the joint holes 11*a*. The electrode layer 12*a* is electrically connected to the feeding line 13.

The fixed connection section 23 of the chip antenna 2 is a plurality of pins 23*a*. A conductive layer 24*a* is arranged on a surface of the pins 23*a*. In this embodiment, a number of the pins 23*a* is two but is not limited to two.

When the circuit board 1 and the chip antenna 2 are electrically combined, the pins 23*a* of the chip antenna 2 are through the joint holes 11*a* of the circuit board 1, so that the conductive layer 24*a* is electrically connected to the electrode layer 12*a*, so that the chip antenna 2 is fixedly connected onto the circuit board 1 in a vertical upright manner or a horizontal upright manner to reduce the height. The chip antenna 2 is firmly and electrically fixed to the circuit board 1 at the same time.

Figure 7:
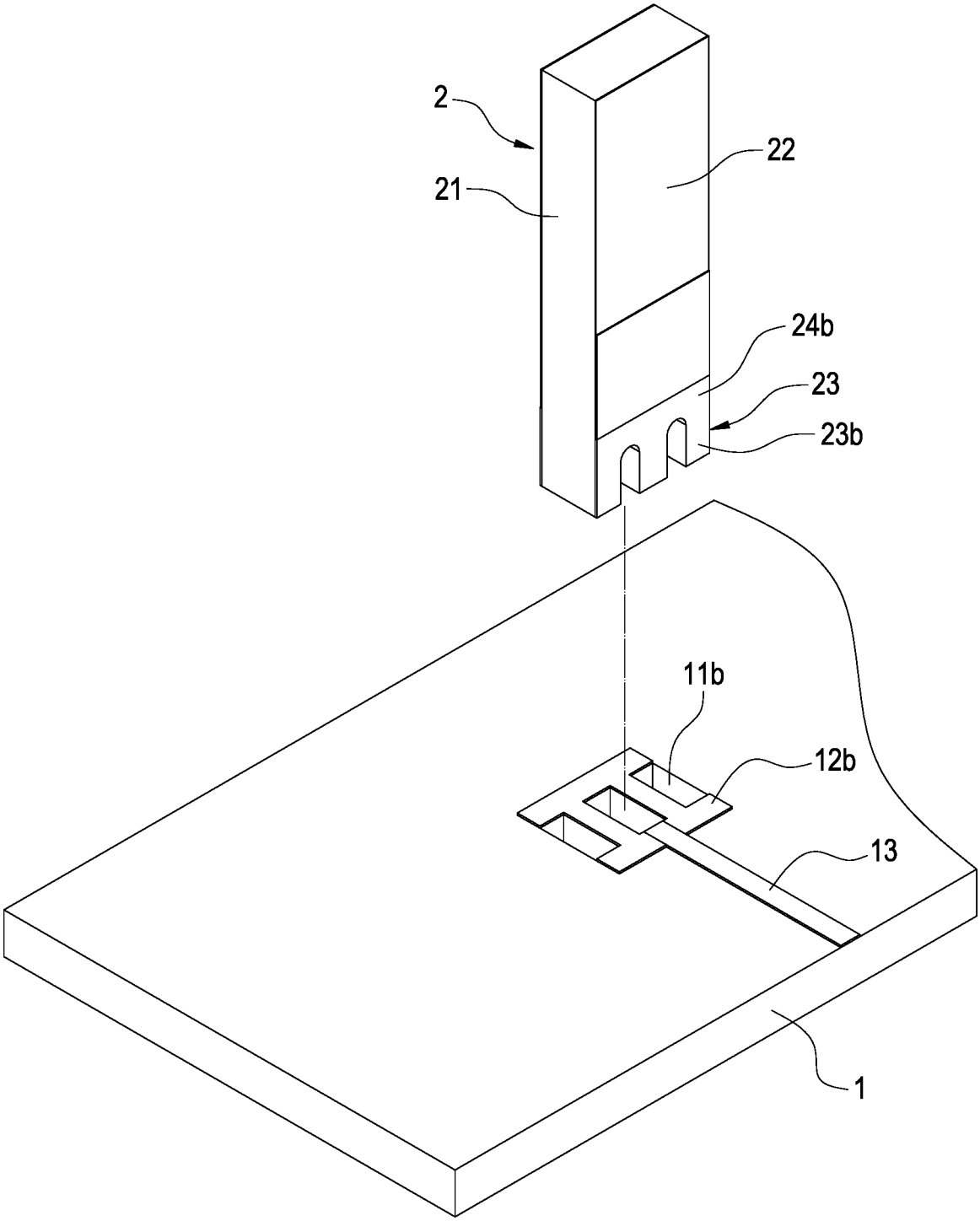
FIG. 7 shows an exploded view of the third embodiment of the antenna structure of the present disclosure.
Figure 8:
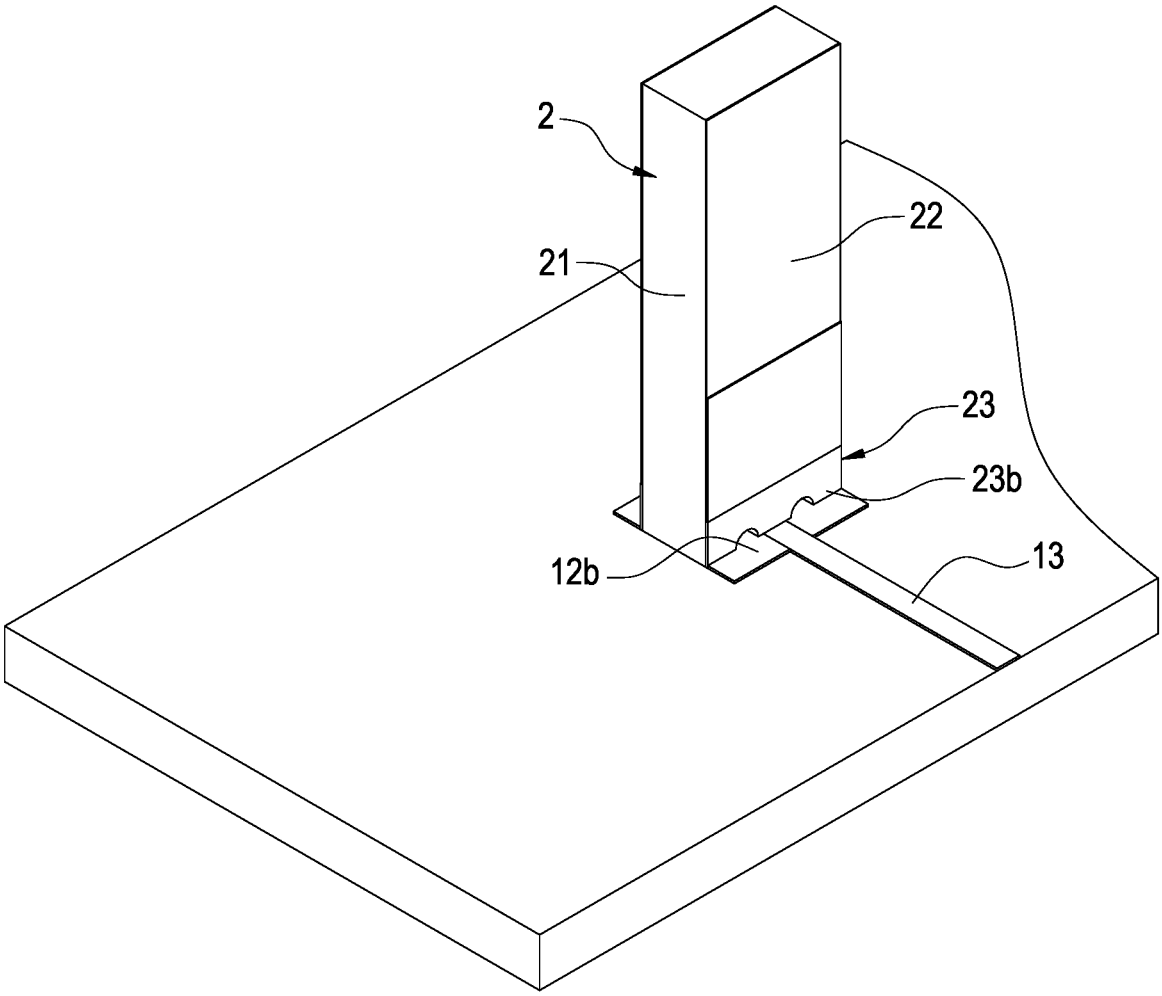
FIG. 8 shows a three-dimensional combination drawing of FIG. 7.

FIG. 7 shows an exploded view of the third embodiment of the antenna structure of the present disclosure. FIG. 8 shows a three-dimensional combination drawing of FIG. 7. As shown in FIG. 7 and FIG. 8, this embodiment is roughly the same as the first embodiment and the second embodiment, except that the joint holes 11*b* of the circuit board 1 are a plurality of holes. In this embodiment, the joint holes 11*b* are three holes. At least one electrode layer 12*b* of the circuit board 1 is formed on a periphery of the joint holes 11*b*. The electrode layer 12*b* is electrically connected to the feeding line 13. In FIG. 7 and FIG. 8, the electrode layer 12*b* has a pattern of Roman numeral II.

The fixed connection section 23 of the chip antenna 2 is a plurality of terminals 23*b*. A conductive layer 24*b* is arranged on a surface of the terminals 23*a*. In this embodiment, a number of the terminals 23*a* is three but is not limited to three.

When the circuit board 1 and the chip antenna 2 are electrically combined, the terminals 23*b* of the chip antenna 2 are through the joint holes 11*b* of the circuit board 1, so that the conductive layer 24*b* is electrically connected to the electrode layer 12*b*, so that the chip antenna 2 is fixedly connected onto the circuit board 1 in a vertical upright manner or a horizontal upright manner to reduce the height. The chip antenna 2 is firmly and electrically fixed to the circuit board 1 at the same time.

Figure 9:
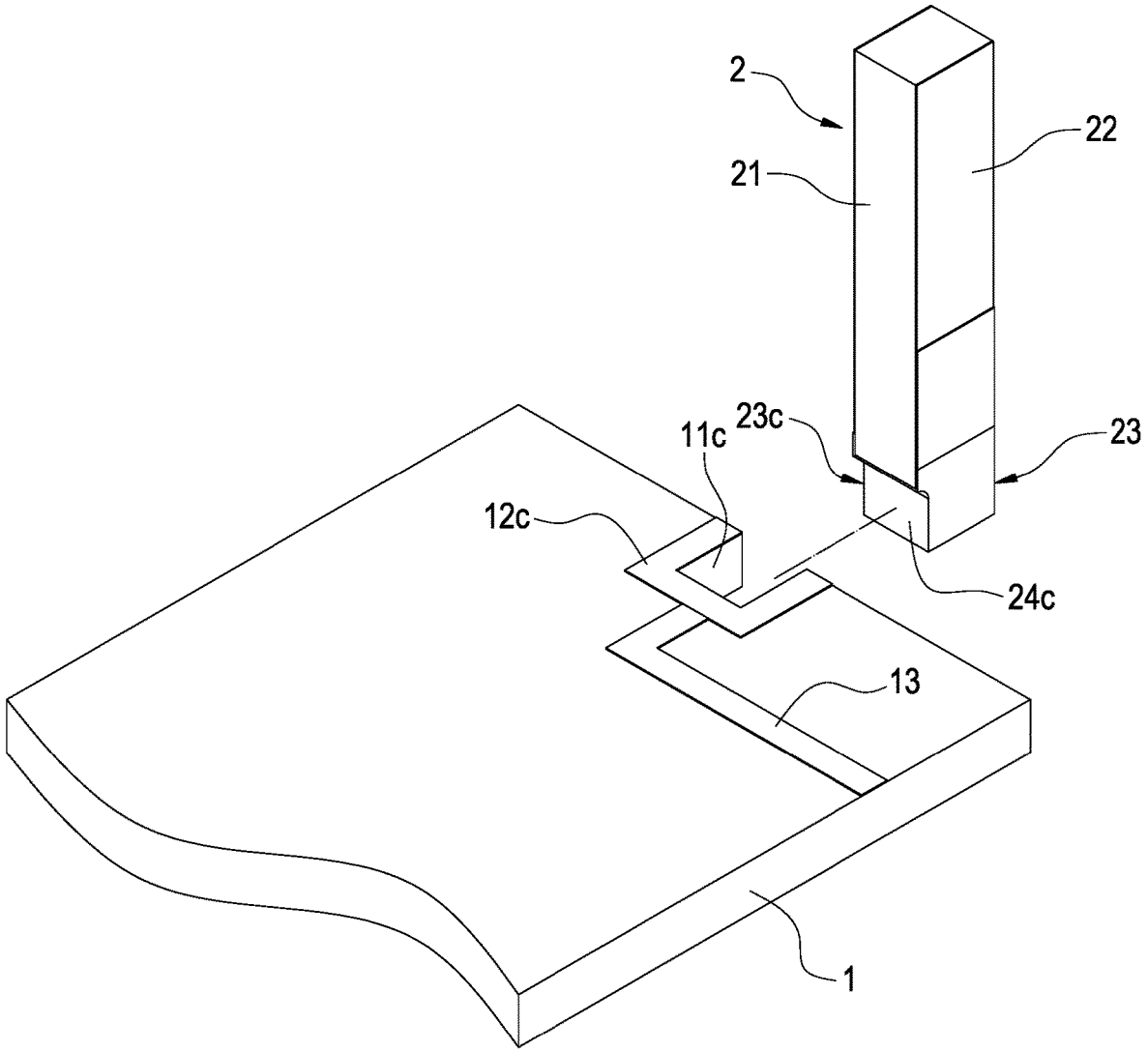
FIG. 9 shows an exploded view of the fourth embodiment of the antenna structure of the present disclosure.
Figure 10:
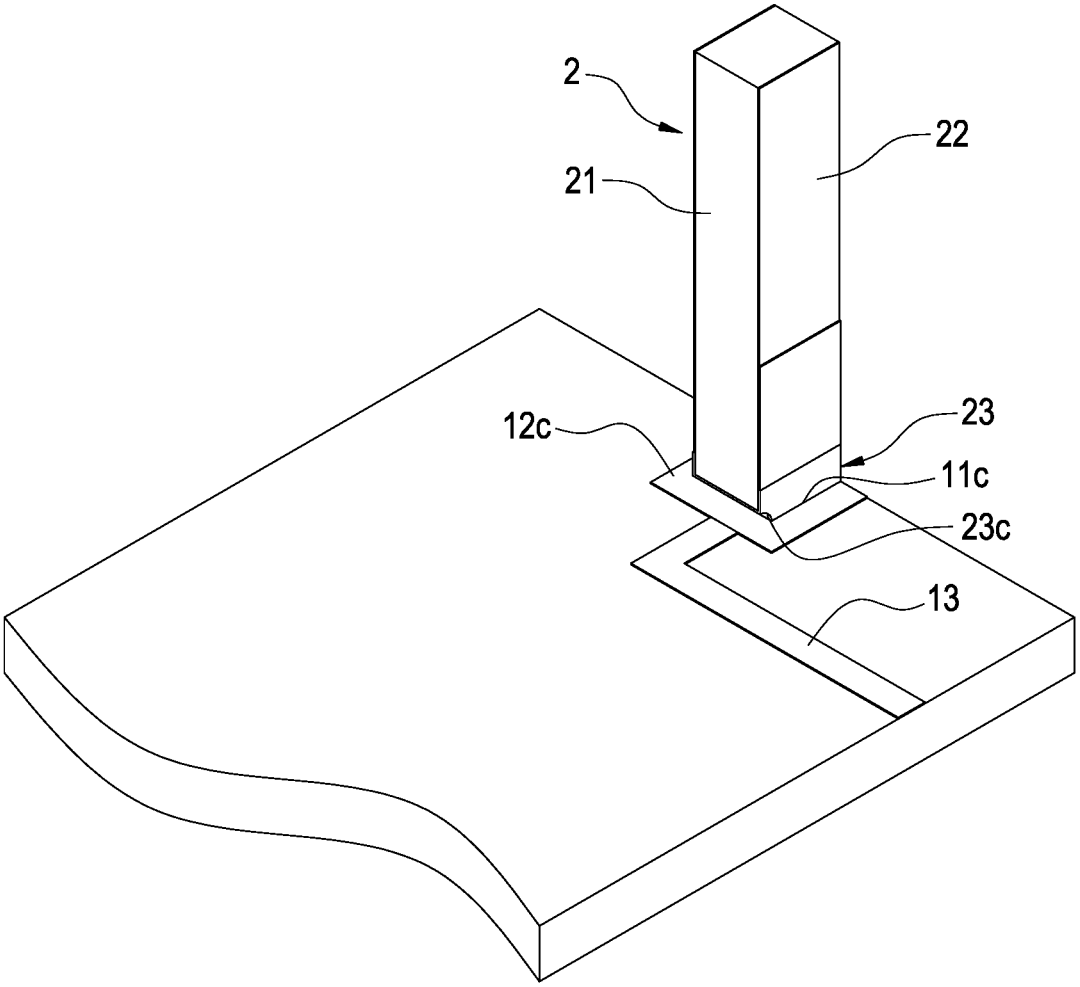
FIG. 10 shows a three-dimensional combination drawing of FIG. 9.

FIG. 9 shows an exploded view of the fourth embodiment of the antenna structure of the present disclosure. FIG. 10 shows a three-dimensional combination drawing of FIG. 9. As shown in FIG. 9 and FIG. 10, this embodiment is roughly the same as the first embodiment, the second embodiment and the third embodiment, except that the joint hole 11 of the circuit board 1 is the design of a side hole 11*c*. At least one electrode layer 12*c* of the circuit board 1 is formed on a periphery of the side hole 11*c*. The electrode layer 12*c* is electrically connected to the feeding line 13. In FIG. 9 and FIG. 10, the side hole 11*c* is a U shape.

A recessed part 23*c* is arranged (defined) at a side of the fixed connection section 23 of the chip antenna 2. A conductive layer 24*c* is arranged on a surface of the fixed connection section 23 and the recessed part 23*c*. In FIG. 9 and FIG. 10, the recessed part 23*c* is an L shape.

When the circuit board 1 and the chip antenna 2 are electrically combined, the recessed part 23*c* of the chip antenna 2 is through the circuit board 1 to be fixedly connected to the side hole 11*c*, so that the conductive layer 24*c* is electrically connected to the electrode layer 12*c*, so that the chip antenna 2 is fixedly connected onto the circuit board 1 in a vertical upright manner or a horizontal upright manner to reduce the height. The chip antenna 2 is firmly and electrically fixed to the circuit board 1 at the same time.

Figure 11:
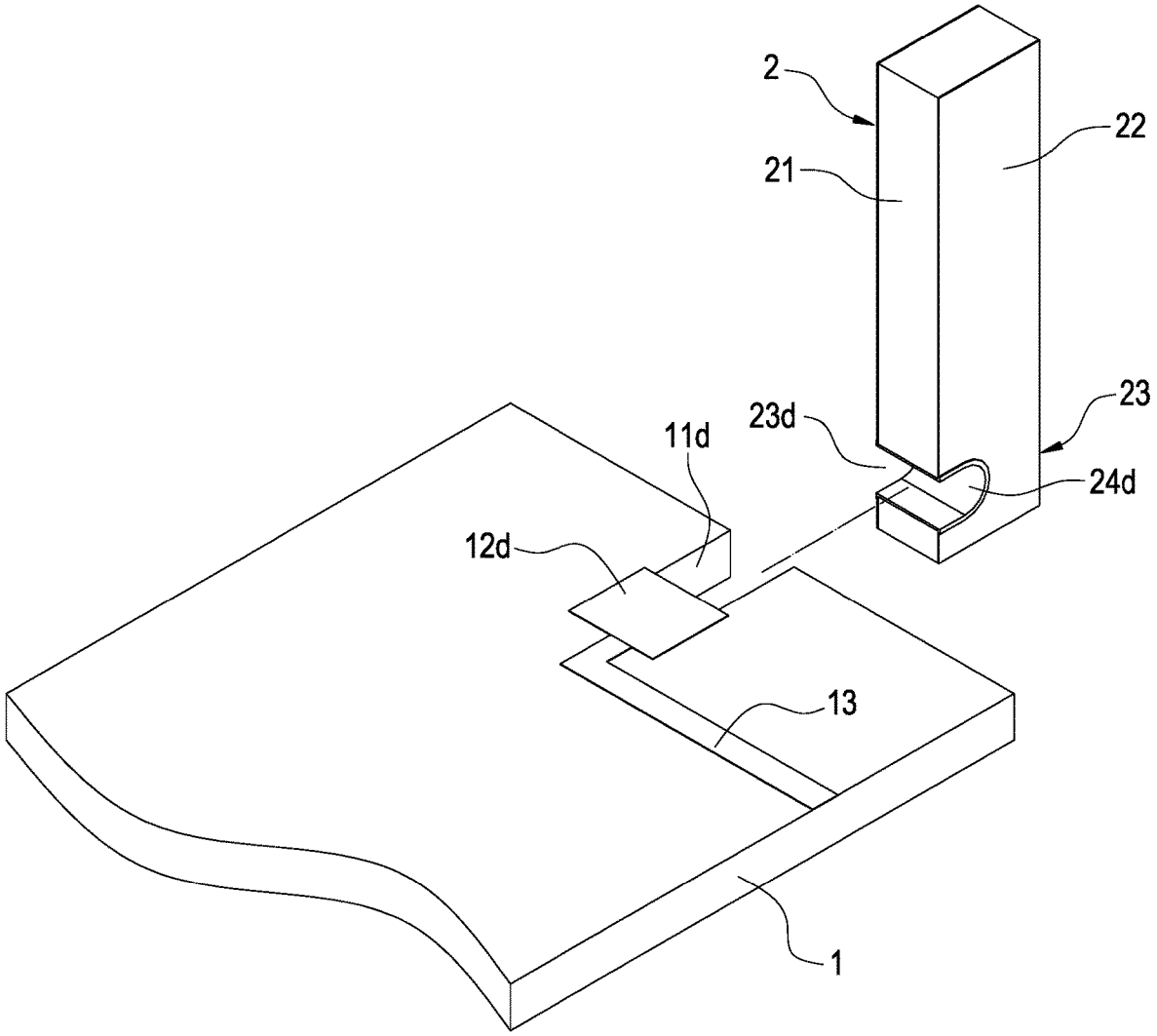
FIG. 11 shows an exploded view of the fifth embodiment of the antenna structure of the present disclosure.
Figure 12:
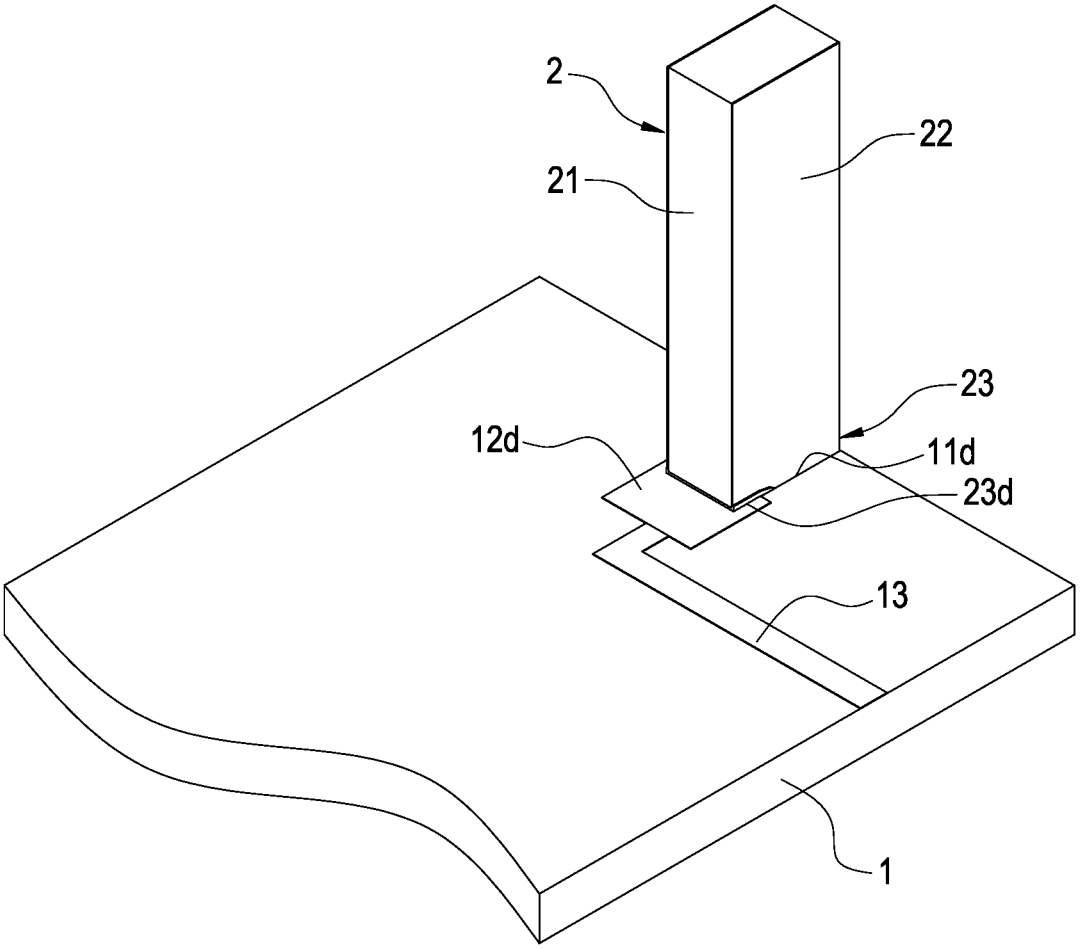
FIG. 12 shows a three-dimensional combination drawing of FIG. 11.
Figure 13:
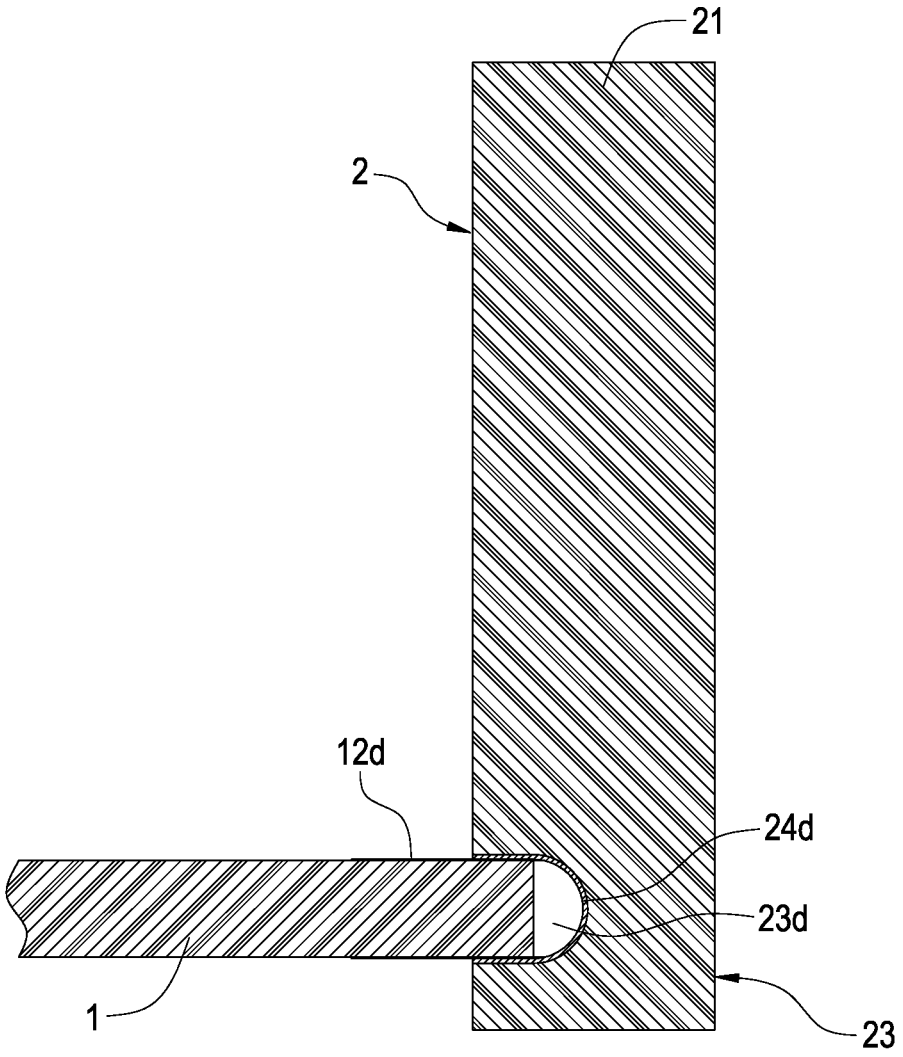
FIG. 13 shows a side sectional view of FIG. 12.

FIG. 11 shows an exploded view of the fifth embodiment of the antenna structure of the present disclosure. FIG. 12 shows a three-dimensional combination drawing of FIG. 11. FIG. 13 shows a side sectional view of FIG. 12. As shown in FIG. 11, FIG. 12 and FIG. 13, this embodiment is roughly the same as the first embodiment, the second embodiment, the third embodiment and the fourth embodiment, except that the joint hole 11 of the circuit board 1 is the design of a side hole 11*d*. At least one electrode layer 12*d* of the circuit board 1 is formed on a periphery of the side hole 11*d*. The electrode layer 12*d* is electrically connected to the feeding line 13. In FIG. 11, FIG. 12 and FIG. 13, the side hole 11*d* is a U shape.

A notch 23*d* is arranged (defined) at a side of the fixed connection section 23 of the chip antenna 2. A conductive layer 24*d* is arranged on a periphery of the notch 23*d*. In FIG. 11, FIG. 12 and FIG. 13, the notch 23*d* is a U shape. An opening of the notch 23*d* and the body of the chip antenna 2 are arranged in a perpendicular relationship with each other.

When the circuit board 1 and the chip antenna 2 are electrically combined, the notch 23*d* of the chip antenna 2 is through the circuit board 1 to be fixedly connected to the side hole 11*d*, so that the conductive layer 24*d* is electrically connected to the electrode layer 12*d*, so that the chip antenna 2 is fixedly connected onto the circuit board 1 in an upright manner to reduce the height, wherein the chip antenna 2 and the circuit board 1 are arranged in a perpendicular relationship with each other. The chip antenna 2 is firmly and electrically fixed to the circuit board 1 at the same time.

Figure 14:
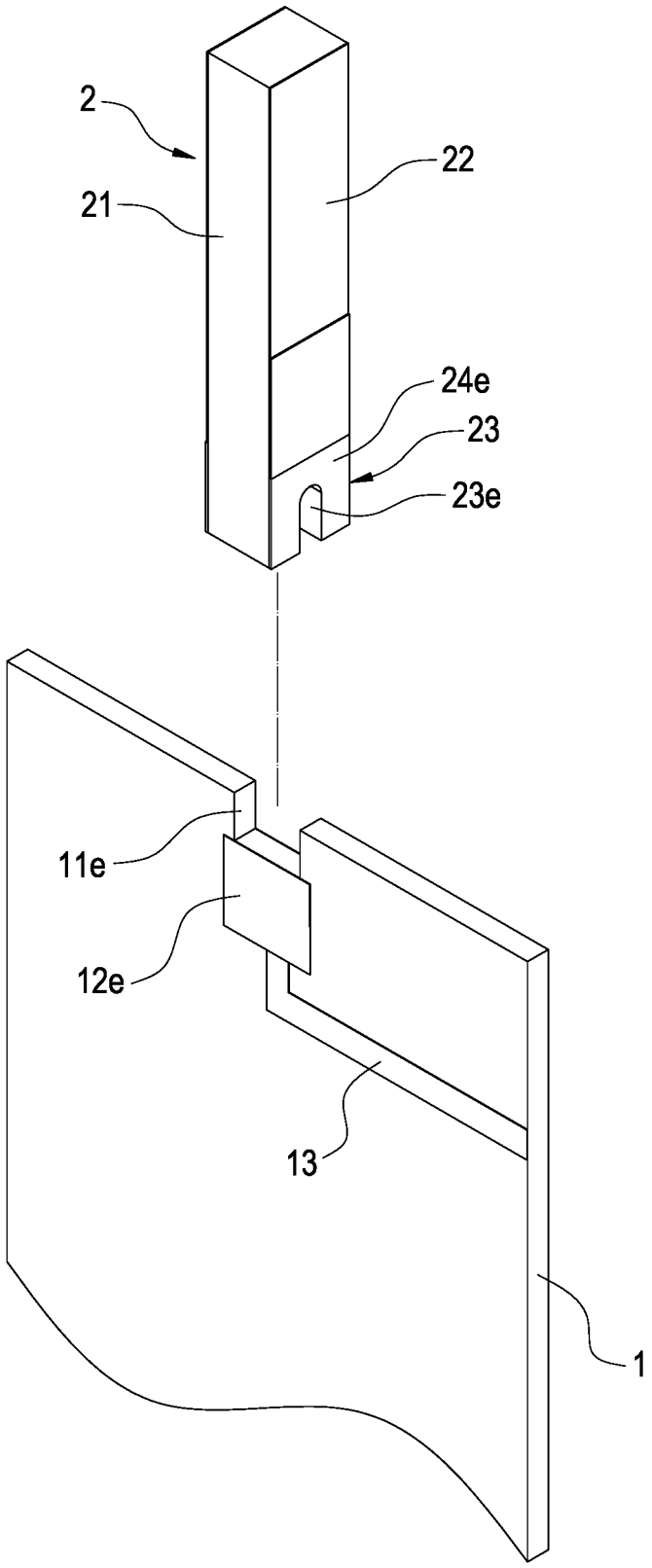
FIG. 14 shows an exploded view of the sixth embodiment of the antenna structure of the present disclosure.
Figure 15:
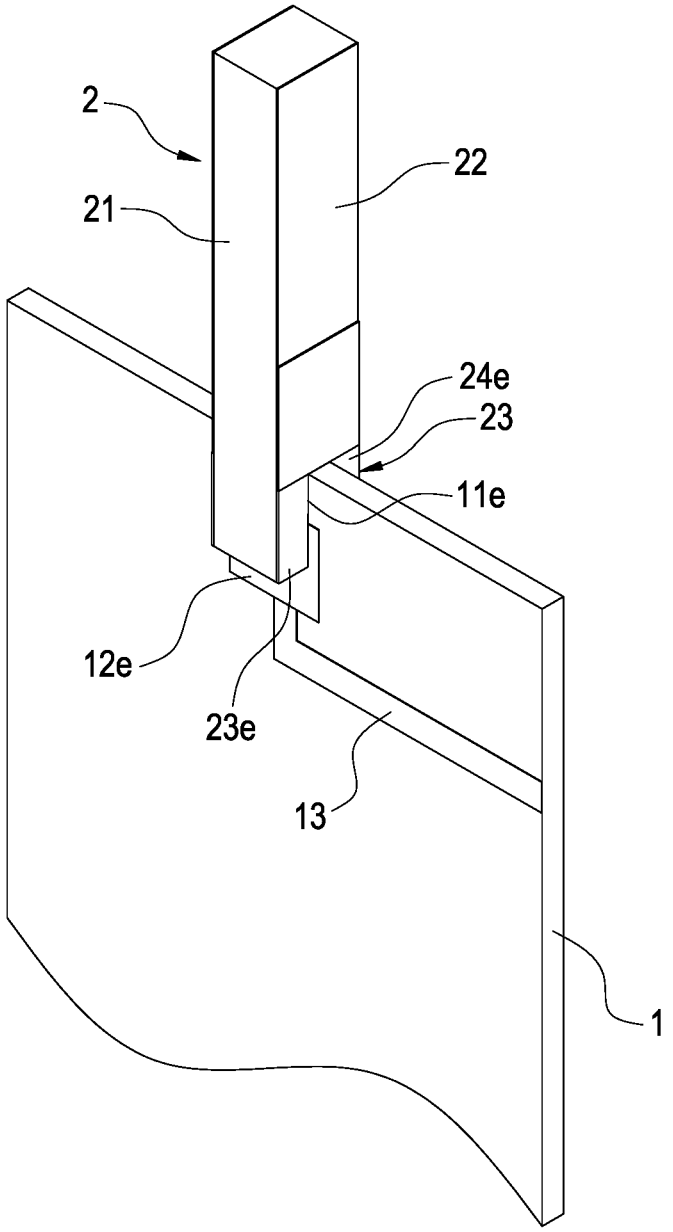
FIG. 15 shows a three-dimensional combination drawing of FIG. 14.

FIG. 14 shows an exploded view of the sixth embodiment of the antenna structure of the present disclosure. FIG. 15 shows a three-dimensional combination drawing of FIG. 14. As shown in FIG. 14 and FIG. 15, this embodiment is roughly the same as the first embodiment, the second embodiment, the third embodiment, the fourth embodiment and the fifth embodiment, except that the joint hole 11 of the circuit board 1 is the design of a side hole 11*e*. At least one electrode layer 12*e* of the circuit board 1 is formed on a periphery of the side hole 11*e*. The electrode layer 12*e* is electrically connected to the feeding line 13. In FIG. 14 and FIG. 15, the side hole 11*e* is a U shape.

A notch 23*e* is arranged (defined) at a side of the fixed connection section 23 of the chip antenna 2. A conductive layer 24*e* is arranged on a periphery of the notch 23*e*. In FIG. 14 and FIG. 15, the notch 23*e* is a U shape. An opening of the notch 23*e* and the body of the chip antenna 2 are arranged in a coaxial relationship.

When the circuit board 1 and the chip antenna 2 are electrically combined, the notch 23*e* of the chip antenna 2 is through the circuit board 1 to be fixedly connected to the side hole 11*e*, so that the conductive layer 24*e* is electrically connected to the electrode layer 12*e*, so that the chip antenna 2 is fixedly connected onto the circuit board 1 in a vertical upright manner or a horizontal upright manner to reduce the height after the chip antenna 2 is fixedly connected. The chip antenna 2 is firmly and electrically fixed to the circuit board 1 at the same time.

Figure 16:
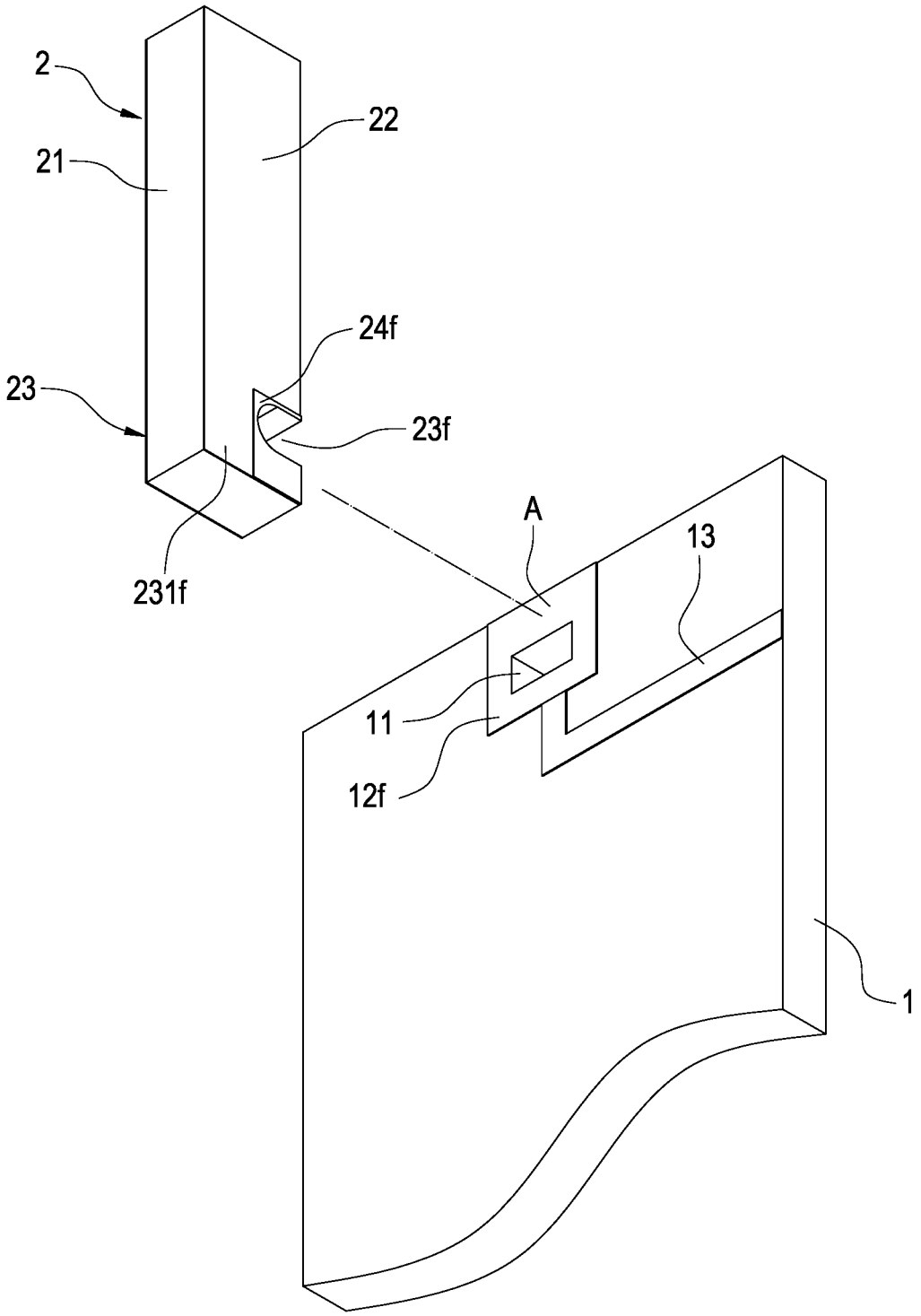
FIG. 16 shows an exploded view of the seventh embodiment of the antenna structure of the present disclosure.
Figure 17:
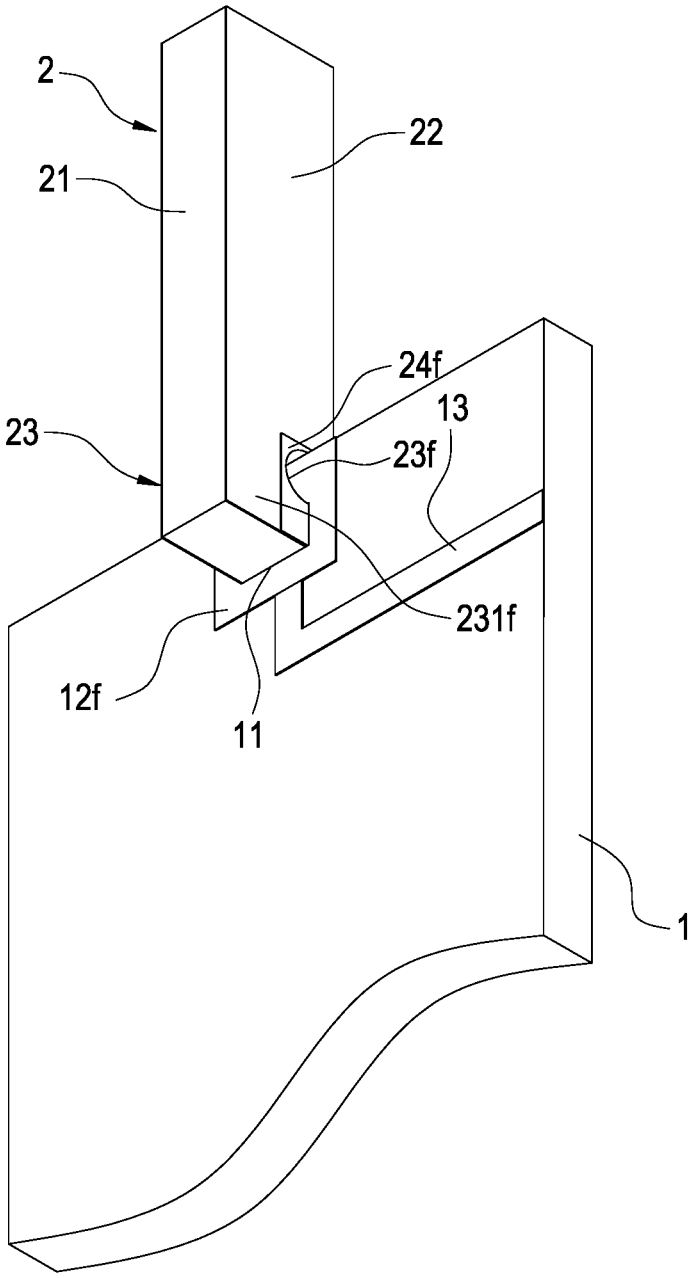
FIG. 17 shows a three-dimensional combination drawing of FIG. 16.

FIG. 16 shows an exploded view of the seventh embodiment of the antenna structure of the present disclosure. FIG. 17 shows a three-dimensional combination drawing of FIG. 16. As shown in FIG. 16 and FIG. 17, this embodiment is roughly the same as the first embodiment, the second embodiment, the third embodiment, the fourth embodiment, the fifth embodiment and the sixth embodiment, except that the joint hole 11 is located (defined) at a side of the circuit board 1 and has a specific distance A from the side. An electrode layer 12*f* is arranged on the periphery of the joint hole 11 and the specific distance A. The electrode layer 12*f* is electrically connected to the feeding line 13.

A notch 23*f* is arranged (defined) at a side of the fixed connection section 23 of the chip antenna 2. A conductive layer 24*f* is arranged on a periphery of the notch 23*f* In FIG. 16 and FIG. 17, the notch 23*f* is a U shape. An opening of the notch 23*f* and the body of the chip antenna 2 are arranged in a perpendicular relationship.

When the circuit board 1 and the chip antenna 2 are electrically combined, a lower part 231*f* of the notch 23*f* of the chip antenna 2 is through the circuit board 1 to be fixedly connected to the joint hole 11. The notch 23*f* is connected across on the specific distance A of the circuit board 1, so that the conductive layer 24*f* is electrically connected to the electrode layer 12*f*, so that the chip antenna 2 is fixedly connected onto the circuit board 1 in a vertical upright manner or a horizontal upright manner to reduce the height after the chip antenna 2 is fixedly connected. The chip antenna 2 is firmly and electrically fixed to the circuit board 1 at the same time.

However, the above descriptions are only the preferred embodiments of the present disclosure, and are not intended to limit the scope of the claims of the present disclosure. Therefore, all equivalent changes made by using the descriptions or the drawings of the present disclosure are included in the scope of the claims of the present disclosure in the same way.

What is claimed is:

1. An antenna-structure combination method comprising:

a) providing a circuit board, wherein at least one joint hole defined by the circuit board and penetrating the circuit board is formed in the circuit board, wherein at least one electrode layer of the circuit board and one feeding line of the circuit board are formed on a periphery of the joint hole, wherein the feeding line is electrically connected to the electrode layer;

b) providing a chip antenna, wherein the chip antenna comprises a base, wherein the base has a wiring section, wherein a fixed connection section of the wiring section is arranged at one end of the wiring section, wherein the fixed connection section is formed with a conductive layer; and c) the fixed connection section of the chip antenna penetrating the joint hole of the circuit board, so that the conductive layer is electrically fixed to the electrode layer, so that the chip antenna is fixedly connected onto the circuit board in an upright manner.

2. The antenna-structure combination method of claim 1, wherein the chip antenna is fixedly connected onto the circuit board in a vertical upright manner.

3. The antenna-structure combination method of claim 1, wherein the chip antenna is fixedly connected onto the circuit board in a horizontal upright manner.

4. The antenna-structure combination method of claim 1, wherein a grounding layer of the circuit board is formed on:

a front side of the circuit board or a back side of the circuit board; or both the front side and the back side, wherein a clearance area of the circuit board is formed on the back side of the circuit board, wherein the clearance area is corresponding to the electrode layer on the front side of the circuit board.

5. The antenna-structure combination method of claim 1, wherein the joint hole is formed inside a body of the circuit board, or at a side of the body of the circuit board to be formed as a u-shaped side hole.

6. The antenna-structure combination method of claim 1, wherein the joint hole is single-hole, two-hole or three-hole.

7. The antenna-structure combination method of claim 1, wherein the chip antenna is made of a ceramic material or a glass fiber material.

8. The antenna-structure combination method of claim 1, wherein the wiring section is formed with a metal layer.

9. The antenna-structure combination method of claim 8, wherein the metal layer comprises a plurality of straight lines arranged on a surface of the base and a plurality of conductive pillars penetrating the base, wherein the conductive pillars are through the base and are electrically connected to the straight lines arranged on the surface of the base, so that the straight lines and the conductive pillars are spirally wound on the base.

10. The antenna-structure combination method of claim 1, wherein the fixed connection section is a column shape, a plurality of pins, a plurality of terminals, a recessed part or a u-shaped notch.

11. The antenna-structure combination method of claim 10, wherein the joint hole is located on a side of the circuit board and has a specific distance from the side, wherein the electrode layer is arranged on the periphery of the joint hole and the specific distance, wherein the electrode layer is electrically connected to the feeding line.

12. The antenna-structure combination method of claim 11, wherein a lower part of the u-shaped notch of the chip antenna is through the circuit board to be fixedly connected to the joint hole, wherein the u-shaped notch is connected across on the specific distance of the circuit board, so that the conductive layer is electrically connected to the electrode layer.

13. An antenna structure comprising:

a circuit board, wherein at least one joint hole defined by the circuit board and through the circuit board is formed in the circuit board, wherein at least one electrode layer of the circuit board and one feeding line of the circuit board are formed on a periphery of the joint hole, wherein the feeding line is electrically connected to the electrode layer; and a chip antenna, wherein the chip antenna comprises a base, wherein the base has a wiring section, wherein a fixed connection section of the wiring section is arranged at one end of the wiring section, wherein the fixed connection section is formed with a conductive layer, wherein the fixed connection section of the chip antenna is through the joint hole of the circuit board, so that the conductive layer is electrically fixed to the electrode layer, so that the chip antenna is fixedly connected onto the circuit board in an upright manner.

14. The antenna structure of claim 13, wherein the chip antenna is fixedly connected onto the circuit board in a vertical upright manner.

15. The antenna structure of claim 13, wherein the chip antenna is fixedly connected onto the circuit board in a horizontal upright manner.

16. The antenna structure of claim 13, wherein a grounding layer of the circuit board is formed on:

a front side of the circuit board or a back side of the circuit board; or both the front side and the back side, wherein a clearance area of the circuit board is formed on the back side of the circuit board, wherein the clearance area is corresponding to the electrode layer on the front side of the circuit board.

17. The antenna structure of claim 13, wherein the joint hole is formed inside a body of the circuit board, or at a side of the body of the circuit board to be formed as a u-shaped side hole.

18. The antenna structure of claim 13, wherein the joint hole is single-hole, two-hole or three-hole.

19. The antenna structure of claim 13, wherein the chip antenna is made of a ceramic material or a glass fiber material.

20. The antenna structure of claim 13, wherein the wiring section is formed with a metal layer.

21. The antenna structure of claim 20, wherein the metal layer comprises a plurality of straight lines arranged on a surface of the base and a plurality of conductive pillars through the base, wherein the conductive pillars are through the base and are electrically connected to the straight lines arranged on the surface of the base, so that the straight lines and the conductive pillars are spirally wound on the base.

22. The antenna structure of claim 13, wherein the fixed connection section is a column shape, a plurality of pins, a plurality of terminals, a recessed part or a u-shaped notch.

23. The antenna structure of claim 22, wherein the joint hole is located on a side of the circuit board and has a specific distance from the side, wherein the electrode layer is arranged on the periphery of the joint hole and the specific distance, wherein the electrode layer is electrically connected to the feeding line.

24. The antenna structure of claim 23, wherein a lower part of the u-shaped notch of the chip antenna is through the circuit board to be fixedly connected to the joint hole, wherein the u-shaped notch is connected across on the specific distance of the circuit board, so that the conductive layer is electrically connected to the electrode layer.

* * * * *